US008997994B1

(12) United States Patent
Jung

(10) Patent No.: US 8,997,994 B1
(45) Date of Patent: Apr. 7, 2015

(54) PORTABLE KITCHEN STORAGE CABINET

(71) Applicant: Jeffrey A. Jung, North Fort Myers, FL (US)

(72) Inventor: Jeffrey A. Jung, North Fort Myers, FL (US)

( * ) Notice: Subject to any disclaimer, the term of this patent is extended or adjusted under 35 U.S.C. 154(b) by 0 days.

(21) Appl. No.: 14/024,057

(22) Filed: Sep. 11, 2013

(51) Int. Cl.
*A45C 11/20* (2006.01)
*A47B 46/00* (2006.01)
*B60R 9/06* (2006.01)

(52) U.S. Cl.
CPC ..... *B60R 9/065* (2013.01)

(58) Field of Classification Search
USPC ..... 206/216, 223, 372, 373, 541–549; 220/592.2–592.27; 312/240, 244, 245, 312/257.1–265.6, 228, 237, 257.1–265.6, 312/200, 276, 293.2, 309; 190/100–102; 224/402–405, 416
See application file for complete search history.

(56) References Cited

U.S. PATENT DOCUMENTS 904,545 A * 11/1908 Madeira ..... 312/293.2
2,261,605 A * 11/1941 Smith ..... 312/200
2,557,218 A * 6/1951 Ewell ..... 312/276
2,662,989 A * 12/1953 Thatcher ..... 312/244
2,944,862 A * 7/1960 Heil ..... 312/237
2,983,367 A * 5/1961 Parmater et al. ..... 312/328
3,301,619 A * 1/1967 Mead ..... 312/200
4,108,310 A * 8/1978 Aldridge et al. ..... 206/570
4,266,835 A * 5/1981 Schmidt ..... 312/244
4,588,074 A * 5/1986 Strong et al. ..... 206/752
4,717,020 A * 1/1988 Viira ..... 206/372
5,269,599 A * 12/1993 Moring ..... 312/290
5,281,016 A 1/1994 Brague
5,683,157 A * 11/1997 Peterson et al. ..... 312/228
5,730,344 A * 3/1998 Mauch ..... 224/402
6,173,839 B1 1/2001 Dieter et al.
8,763,848 B2 * 7/2014 Carey ..... 220/592.2

* cited by examiner

*Primary Examiner* — Bryon Gehman
(74) *Attorney, Agent, or Firm* — Crossley Patent Law

(57) ABSTRACT

A portable kitchen storage cabinet sized appropriately to fit atop a tailgate of an extant pickup truck, the portable kitchen storage cabinet including a rectangular prismatic box having a triangular prismatic lid section hingedly disposed at a front surface of the box, the lid section imposable into the rectangular prismatic box when moved to a closed position, the lid section moveable into an open position disposed in front of the front surface of the box, wherein the interior of the box is partitioned by a first shelf, a second shelf, a vertically oriented first partition, and a vertically oriented second partition, whereby extant kitchen utensils and accoutrements are storable sorted inside the box and readily transportable and accessible therein.

2 Claims, 4 Drawing Sheets

PORTABLE KITCHEN STORAGE CABINET

BACKGROUND OF THE INVENTION

Various types of portable kitchen cabinets are known in the prior art. However, what is needed is a portable kitchen storage cabinet sized appropriately to fit atop a tailgate of an extant pickup truck, said portable kitchen storage cabinet including a rectangular cross-section box having a triangular cross-section lid section hingedly disposed at a front surface of said box, said lid section imposable into the rectangular cross-section box when moved to a closed position, said lid section moveable into an open position disposed in front of the front surface of the box, wherein the interior of the box is partitioned by a first shelf, a second shelf, a vertically oriented first partition, and a vertically oriented second partition, whereby extant kitchen utensils and accoutrements are storable sorted inside the box and readily transportable and accessible therein.

FIELD OF THE INVENTION

The present invention relates to a portable kitchen storage cabinet, and more particularly, to a portable kitchen storage cabinet sized appropriately to fit atop a tailgate of an extant pickup truck, said portable kitchen storage cabinet including a rectangular cross-section box having a triangular cross-section lid section hingedly disposed at a front surface of said box, said lid section imposable into the rectangular cross-section box when moved to a closed position, said lid section moveable into an open position disposed in front of the front surface of the box, wherein the interior of the box is partitioned by a first shelf, a second shelf, a vertically oriented first partition, and a vertically oriented second partition, whereby extant kitchen utensils and accoutrements are storable sorted inside the box and readily transportable and accessible therein.

SUMMARY OF THE INVENTION

The general purpose of the portable kitchen storage cabinet, described subsequently in greater detail, is to provide a portable kitchen storage cabinet which has many novel features that result in a portable kitchen storage cabinet which is not anticipated, rendered obvious, suggested, or even implied by prior art, either alone or in combination thereof.

The present invention has been devised to enable ready transport and storage of a plurality of extant kitchen utensils and accoutrements in a rectangular cross-section box sized appropriate to fit upon a tailgate of an extant pickup. The present portable kitchen storage cabinet partitions and interior cavity into compartments wherein a variety of kitchen utensils and accoutrements is storable, as desired, for use in the outdoors when camping, for example, at a sporting event, a tailgate party, or other outdoor event where cooking or the preparation of food is desired.

The present portable kitchen storage cabinet, therefore, includes a rectangular cross-section box. The box includes a base, a top surface, a rear surface, a pair of end surfaces, and a front surface. A hinge is medially disposed along a longitudinal axis of the front surface. A lid section is moveably disposed upon the hinge, said lid section thereby moveable between a closed position engaged at the top surface, and an open position folded down in front of the front surface.

The lid section is a triangular cross-section section of the rectangular cross-section box, cut along a plane extended up from the front surface to the top surface, thereby imposable into rectangular cross-section box when in the closed position, and extending an interior surface out from the front surface when folded down into the open position. This interior surface is suited to food preparation and the positioning of plates and cups, for example, for serving of food thereupon.

The lid section is securable in the closed position by a pair of latch members disposed upon the pair of end surfaces. Each of said latch members releasably engages with each of a pair of catches disposed on the lid section at a position where the lid section imposes into each of the pair of end surfaces when moved to the closed position. A pair of handles is disposed upon the pair of end surfaces underlying the lid section, whereby the rectangular cross-section box is portable.

A compartmentalized, interior cavity is disposed inside the box, said interior cavity accessible when the lid section is moved to the open position. The interior cavity includes a first shelf disposed along an interior side of the rear surface to contact an interior side of one of the pairs of end surfaces. The first shelf includes at least one wall transversely disposed atop said first shelf, whereby said first shelf is compartmentalized for storage of silverware, for example. A retaining lip is disposed edgewise along a longitudinal axis of the first shelf in parallel with the interior side of the rear surface to maintain objects upon the first shelf when the rectangular cross-section box is ported. The first shelf is suited for the storage of objects transversely disposed relative the first shelf.

A second shelf is disposed along the interior side of the rear surface in a plane parallel with the first shelf. In the preferred embodiment herein disclosed, the second shelf has a length exceeding the length of the first shelf, and abuts against an interior side of the other of the pair of end surfaces. The second shelf also includes a retaining lip disposed edgewise along a longitudinal axis to prevent objects stored thereupon from rolling off said second shelf during porting of the rectangular cross-section box. The second shelf is suited for storage of objects longitudinally disposed relative said second shelf.

A vertically oriented first partition is disposed upon the base, extending in a vertical orientation between the first shelf and the second shelf. The first partition includes a concave edge disposed underlying said first and second shelves, said concave edge facing the front surface, and a vertical edge disposed between each of the first and second shelves, said vertical edge likewise facing the front surface. A space underlying each of the first and second shelves is thereby partitioned by the first partition having the concave edge, and the space above the first and second shelves is partitioned by the first partition having the vertical edge.

A vertically oriented second partition is disposed upon the base underlying the first shelf, in a position parallel with the first partition. The second partition includes a concave edge disposed facing the front surface. The space underlying the first shelf is therefore partitioned between the interior side of one of the pair of end surfaces, the second partition, and the first partition. The space underlying the second shelf is partitioned by the interior side of the other of the pair of end surfaces and the first partition.

For storage of paper towels, or other wipes, as case may be, a towel bar is disposed on the interior side of one of the pair of end surfaces. A plurality of hooks is disposed on the interior side of the other of the pair of end surfaces, for the suspension of cups, utensils, or other objects thereupon.

The present portable kitchen storage cabinet enables a convenient storage of kitchen utensils and accoutrements, and contains said utensils and accoutrements during transportation, whereby a person can expediently erect an outdoor kitchen for use while camping, engaging in a tailgate party, or other outdoor activity where the service of food is desired.

Thus has been broadly outlined the more important features of the present portable kitchen storage cabinet so that the detailed description thereof that follows may be better understood and in order that the present contribution to the art may be better appreciated.

Objects of the present portable kitchen storage cabinet, along with various novel features that characterize the invention are particularly pointed out in the claims forming a part of this disclosure. For better understanding of the portable kitchen storage cabinet, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
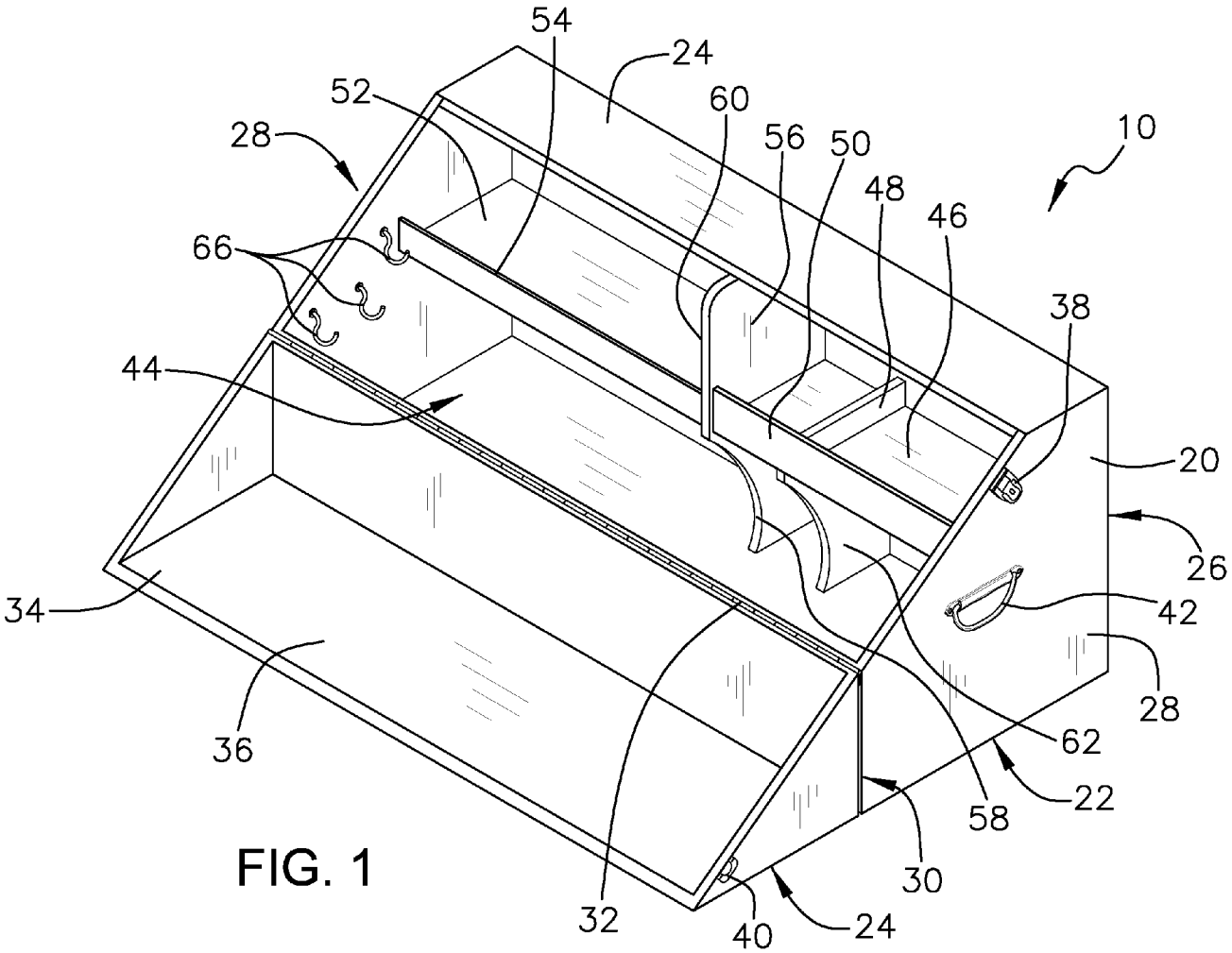
FIG. 1 is an isometric view with a lid section disposed in an open position.
Figure 2:
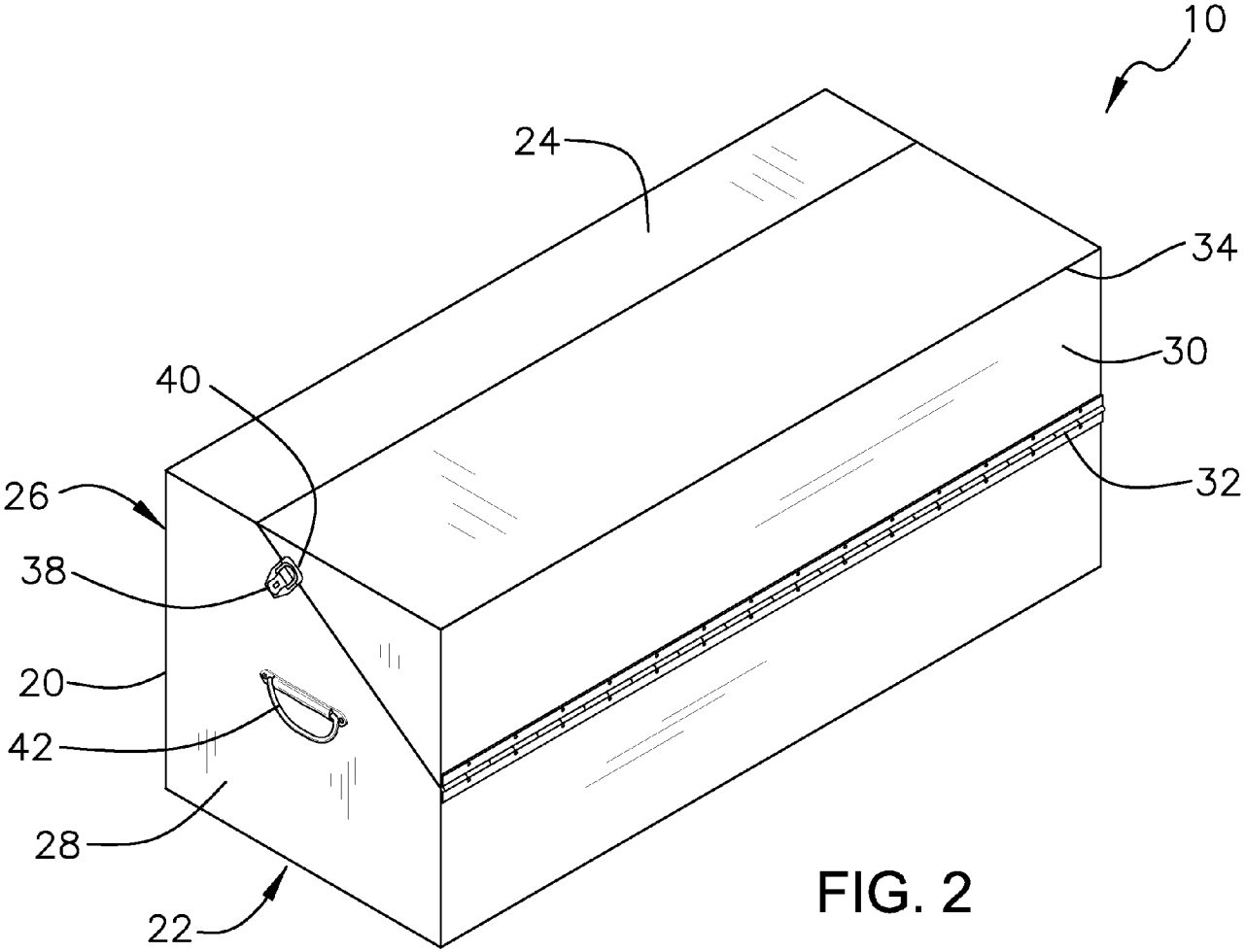
FIG. 2 is an isometric view with the lid section disposed in a closed position.
Figure 3:
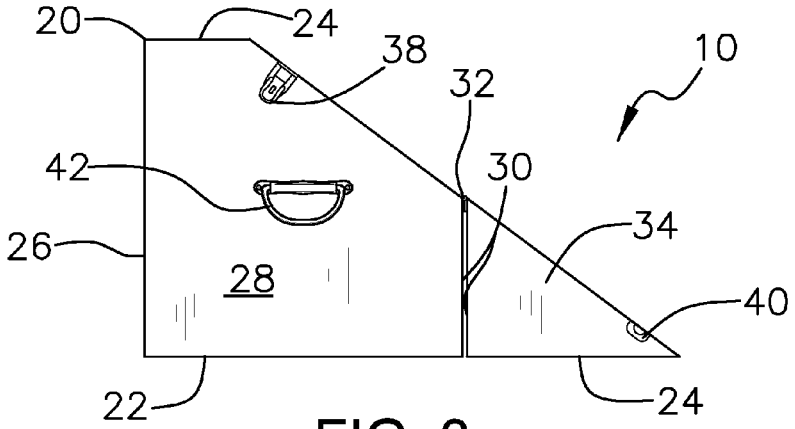
FIG. 3 is a side view with the lid section disposed in the open position.
Figure 4:
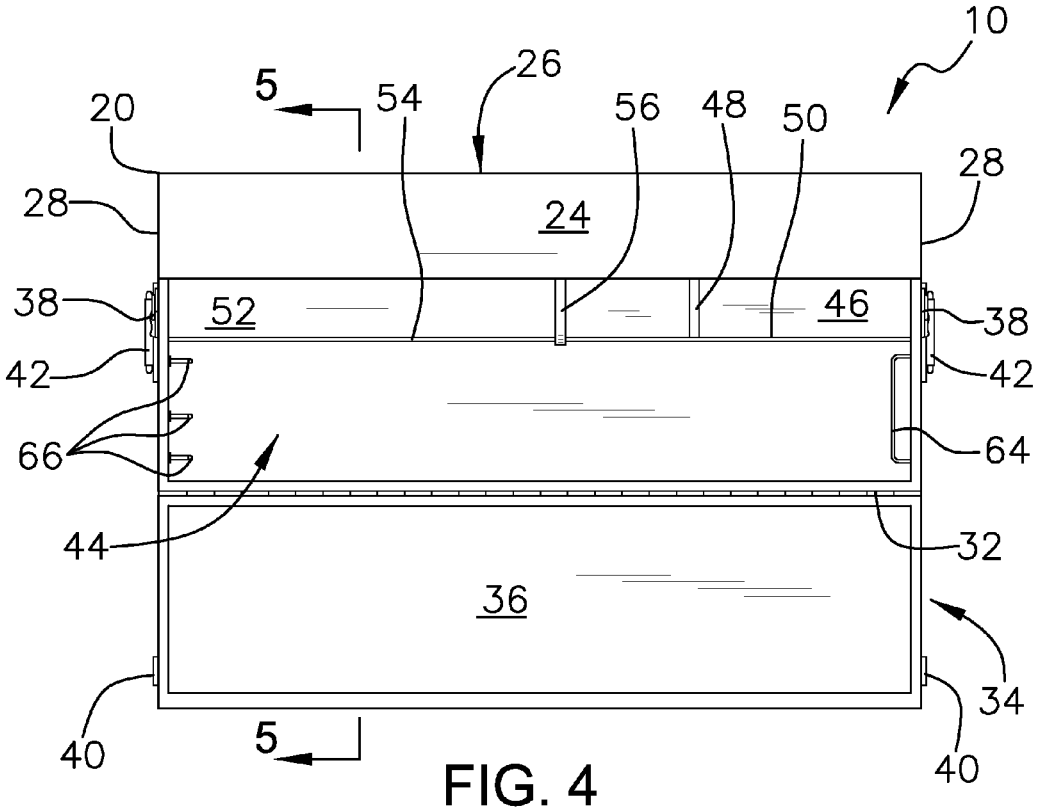
FIG. 4 is a top view with the lid section disposed in the open position.
Figure 5:
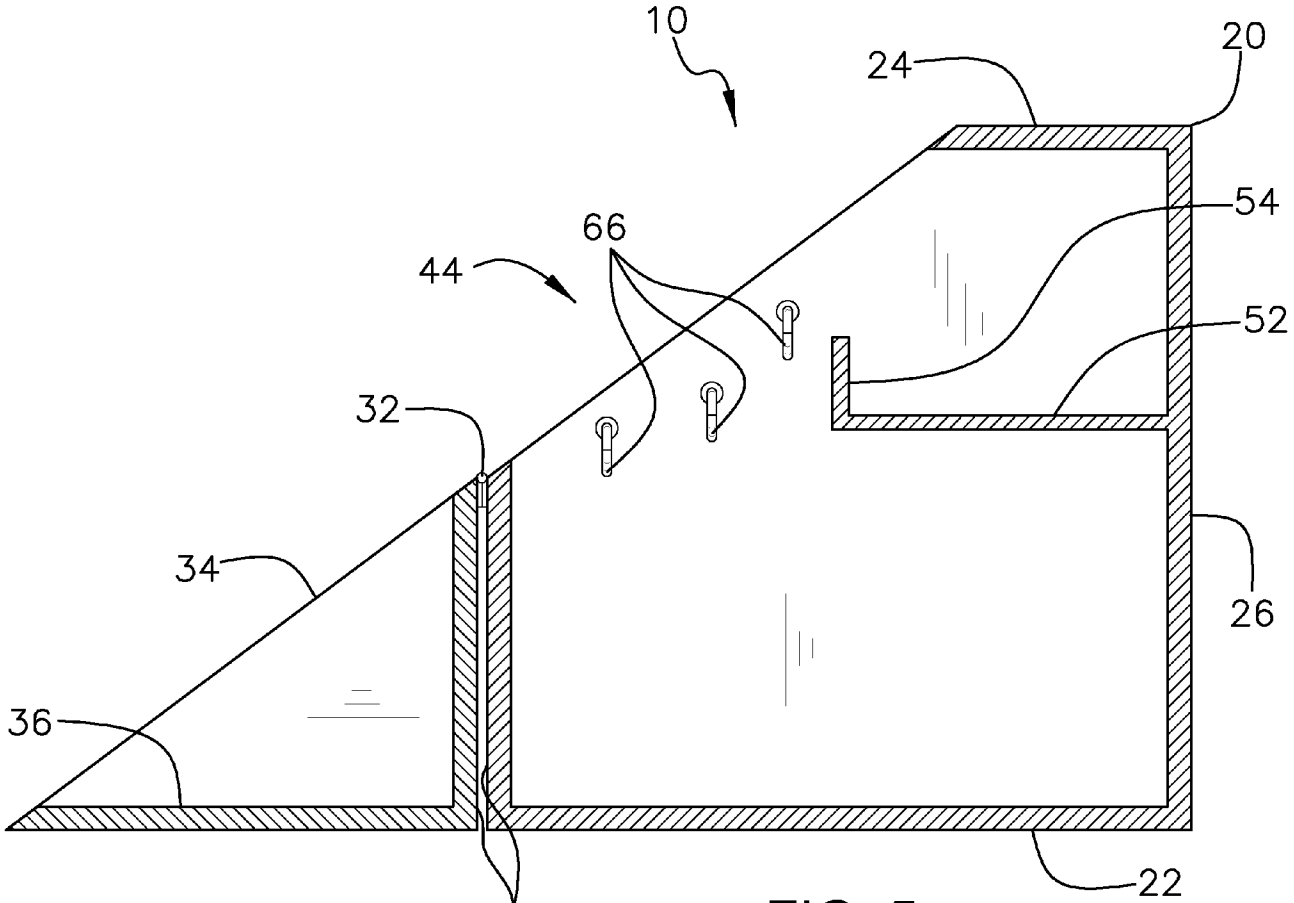
FIG. 5 is a cross-section view taken along the line 5-5 of FIG. 4.

With reference now to the drawings, and in particular FIGS. 1 through 5 thereof, example of the instant portable kitchen storage cabinet employing the principles and concepts of the present portable kitchen storage cabinet and generally designated by the reference number 10 will be described.

Referring to FIGS. 1 through 5 a preferred embodiment of the present portable kitchen storage cabinet 10 is illustrated.

The present device 10 enables convenient storage of kitchen utensils and accoutrements in a portable kitchen storage cabinet 10 whereby an outdoor kitchen may be readily and expediently setup, when desired; utensils and accoutrements typical of a kitchen in the home thereby stored conveniently and accessibly in compartments disposed interior to the instant portable kitchen storage cabinet 10.

The present portable kitchen storage cabinet 10 is sized to fit conveniently upon an extant pickup tailgate. The instant portable kitchen storage cabinet 10 is, therefore, readily useable during tailgate parties, at sporting events, when camping, or when barbequing outside on the patio, for example.

The present portable kitchen storage cabinet 10 includes a rectangular prismatic box 20 sized to fit upon a pickup tailgate. The rectangular cross-section box 20 includes a base 22, a top surface 24, a rear surface 26, a pair of end surfaces 28, and a front surface 30. A hinge 32 is medially disposed along a longitudinal axis of the front surface 30 and a triangular cross-section lid section 34 is disposed at the front surface 30 on the hinge 32.

The triangular cross-section lid section 34 is sectioned from the cross-section box 20, sliced along a planar section of the cross-section box 20 between the top surface 24 and the front surface 30. The lid section 34 is thereby moveable between a closed position, engaged at the top surface 24 and imposable thereby as a section of the rectangular prismatic box 20, and an open position, folded down in front of the front surface 30. When in the open position, the triangular cross-section lid 34 reveals an interior surface 36 for positioning objects upon.

To secure the lid section 34 in the closed position during transport or storage, as case may be, a pair of latch members 38 is disposed upon each of the pair of end surfaces 28, there disposed to releasably engage with each of a pair of catches 40 disposed upon the lid section 34. Thus, when the lid section 34 is moved to the closed position, each of the pair of latches 38 is engaged against the lid section 34 to releasably secure the lid section 34 in the closed position. For ready transport of the rectangular cross-section box 20, each of a pair of handles 42 is disposed on each of the pair of end surfaces 28.

Disposed within the rectangular cross-section box 20 is a compartmentalized interior cavity 44. This interior cavity 44 has been devised to enable storage of kitchen utensils and accoutrements in presorted groups. A first shelf 46 is disposed upon an interior side of the rear surface 26, said first shelf 46 including at least one wall 48 disposed transversely upon the thereupon. The at least one wall 48 compartmentalizes the first shelf 46 into a plurality of compartments for the storage of silverware, say, separated by pertinent type. Of course, other and additional kitchen utensils or accoutrements are storable thereon, as desired. A retaining lip 50 is disposed edgewise perpendicularly atop a longitudinal axis of the first shelf 46 to maintain objects stored thereon in position upon the first shelf 46.

A second shelf 52 is disposed upon the interior side of the rear surface 26, said second shelf 52 disposed in a plane parallel with the first shelf 46. The second shelf 52 also includes a retaining lip 54 disposed edgewise perpendicularly atop a longitudinal axis of the second shelf 52, to maintain objects stored thereupon in position atop said second shelf 52 during transport of the box 20.

A vertically oriented first partition 56 is disposed between the first shelf 46 and the second shelf 52. The vertically oriented first partition 56 includes a concave edge 58, disposed between each of the first and second shelves 46, 52 and the base 22, and a vertical edge 60 disposed between each of the first and second shelves 46, 52 and an interior side of the top surface 24. The first partition 56 divides the space underlying the first and second shelves 46, 52 at the concave edge 58, and divides the space atop the first and second shelves 46, 52 at the vertical edge 60.

A vertically oriented second partition 62 is disposed underlying the first shelf 46 in a position parallel with the first partition 56 to further divide the space underlying the first shelf 46 into compartments between each of the first and second partitions 56, 62 and an interior side of an end surface 28.

For storage of paper towels or other wipes, as case may be, a towel bar 64 is disposed upon an interior side of one of the pair of end surfaces 28. To hang accoutrements such as mugs, for example, or other kitchen utensils or accoutrements, a plurality of hooks 66 is disposed upon an interior side of the other of the pair of end surfaces 28.

Thus, a plurality of extant kitchen utensils and accoutrements are securable, storable, and transportable partitioned within the box 20, as desired, and readily accessible for use in the outdoors when camping, for example, at a sporting event, at a tailgate party, or other occasion where the need for kitchen utensils and accoutrements is realized.

What is claimed is:

1. A portable kitchen storage cabinet sized to fit atop a tailgate of an extant pickup truck, said portable kitchen storage cabinet comprising a rectangular cross-section box, said box comprising a base, a top surface, a rear surface, a pair of end surfaces and a front surface, said box further defined in part by a triangular cross-section lid section hingedly disposed to said front surface of said box, said lid section imposable onto the remainder of the box to define the rectangular cross-section of the box and define a closed position of the box, said lid section hingedly moveable to an open position disposed in front of the front surface of the box with the base being substantially coplanar with the top surface of the lid section, the interior of the box being partitioned by a first shelf, a second shelf, a vertically oriented first partition and a vertically oriented second partition, with extant kitchen utensils and accouterments inside the box and readily transportable and accessible therefrom.

2. A portable kitchen storage cabinet sized to fit conveniently upon an extant pickup tailgate, said cabinet comprising:

a rectangular cross-section box sized to fit upon a pickup tailgate, said box comprising a base, a top surface, a rear surface, a pair of end surfaces, and a front surface;

a hinge medially disposed along a longitudinal axis of the front surface;

a triangular cross-section lid section disposed with the front surface at the hinge, said lid section extending along a diagonal section of the cross-section box between the top surface and the front surface, said lid section being moveable between a closed position, engaged at the top surface and imposed thereon as part of the rectangular cross-section box, and an open position, folded down in front of the front surface with a top surface portion of the lid section substantially coplanar with the box base;

a pair of latch members disposed to secure the lid section in the closed position, each of said pair of latch members disposed upon each of the pair of end surfaces to releasably engage with each of a pair of catches disposed on the lid section;

each of a pair of handles disposed on each of the pair of end surfaces;

a compartmentalized interior cavity disposed inside the box, said interior cavity comprising:

a first shelf disposed upon an interior side of the rear surface abutting an interior side of one of the pair of end surfaces, said first shelf including at least one wall disposed transversely upon the first shelf and a retaining lip disposed edgewise perpendicularly atop a longitudinal axis of the first shelf;

a second shelf disposed upon the interior side of the rear surface abutting an interior side of the other of the pair of end surfaces, said second shelf disposed in a plane parallel with the first shelf, said second shelf including a retaining lip disposed edgewise perpendicularly atop a longitudinal axis of the second shelf;

a vertically oriented first partition disposed between the first shelf and the second shelf, the vertically oriented first partition including a concave edge, disposed between each of the first and second shelves and the base, and a vertical edge disposed between each of the first and second shelves and an interior side of the top surface;

a vertically oriented second partition disposed underlying the first shelf in a position parallel with the first partition;

a towel bar disposed upon an interior side of one of the pair of end surfaces; and a plurality of hooks disposed upon an interior side of the other of the pair of end surfaces;

with a plurality of extant kitchen utensils and accoutrements, accessible for use when said lid section is in the open position.

* * * * *